United States Patent [19]

Forrest

[11] Patent Number: 4,508,193

[45] Date of Patent: Apr. 2, 1985

[54] FRICTION-TYPE DESCENT CONTROL DEVICE

[75] Inventor: William E. Forrest, Denver, Colo.

[73] Assignee: Charles I. Brown, Evergreen, Colo. ; a part interest

[21] Appl. No.: 582,266

[22] Filed: Feb. 22, 1984

[51] Int. Cl.[3] ..... A62B 1/16

[52] U.S. Cl. ..... 182/5; 188/65.4

[58] Field of Search ..... 182/3, 5, 6, 7, 191, 182/192; 188/65.1, 65.2, 65.3, 65.4, 65.5

[56] References Cited

U.S. PATENT DOCUMENTS

| | | | |
|---|---|---|---|
| 1,351,734 | 9/1920 | Barrington | 182/5 |
| 3,022,856 | 2/1962 | Galeano | 188/65.4 |
| 3,217,840 | 11/1965 | Holkesvick | 182/5 |
| 3,695,397 | 10/1972 | Hobbs | 182/5 |
| 3,757,893 | 9/1973 | Hobbs | 182/6 |
| 3,757,901 | 9/1973 | Hobbs | 182/5 |
| 4,311,217 | 1/1982 | Wood | 182/5 |

*Primary Examiner*—Reinaldo P. Machado
*Attorney, Agent, or Firm*—Edwin L. Spangler, Jr.

[57] ABSTRACT

This invention relates to a stationary drum friction-type descent control device for use with a rope and a load-supporting harness characterized by a dogleg arm hanging from one end of a cylindrical friction drum in acute angular relation to its axis cooperating therewith to leave the other end open so that turns of an unloaded medial section of a rope can be added or subtracted therefrom while under load without having to unthread and subsequently rethread the free end of the rope hanging therebeneath or even access the latter. The free end of the drum carries an upstanding post to keep the rope wound around the drum from coming off when slack and to permit the system to be tied off during the descent. A gate in an eye associated with the dogleg arm is either an integral part thereof or an attachment receives the unloaded portion of the rope and cooperates with the post to prevent the rope from uncoiling off the open drum end.

10 Claims, 6 Drawing Figures

FRICTION-TYPE DESCENT CONTROL DEVICE

The prior art manually-operated devices for controlling the rate of descent of a load, oftentimes a human being escaping from a burning building, generally fall into three classes, the first of these using rollers or pulleys over which a rope, strap or the like is reaved. While applicant is aware of such devices in the prior art, they are not considered pertinent to the present invention since the principle of operation has little, if anything, to do with a rope slipping around a stationary drum-forming member. Likewise, those prior art patents based upon the friction developed when a rope slips through eyes formed in a friction member or follows a circuitous path therethrough are far less pertinent than those, of which there are many, wherein a rope is given one or more turns around a non-rotatable drum or similar configuration. Escape devices predicated upon the latter principle are old and well known, some dating back nearly a hundred years. Exemplary of devices using this friction drum idea are the following: 194,443, 296,769, 362,173, 439,263, 518,020, 720,310, 779,550, 1,103,849, 1,351,734, 3,217,840, 3,949,832, 4,311,217.

A critical evaluation of the structures shown in each of the foregoing patents reveals a common deficiency, namely, none of them provides an open-ended fixture which can be attached to a rope at any point throughout its length and in which turns can be added or subtracted under load using an unloaded medial section and without accessing the free end to vary the friction and, thus accommodate additional weight or vary the rate of descent. Under emergency conditions such as attempting an escape from one of the upper stories of a multistoried burning building, having to start with the unloaded free end of the rope to make the initial connection or to have to unthread and subsequently rethread the free end to add or take off turns while suspended in midair can become all but impossible yet necessary with the prior art closed end friction drums. While less traumatic, it is certainly inconvenient to go through the above procedure in order to vary the rate of descent under dangerous, but not necessarily highly stressed conditions such as descending off a mountain.

It has now been found in accordance with the teaching of the present invention that these and other shortcomings of the prior art stationary drum escape devices can be solved by the simple, yet unobvious, expedient of leaving one end of the drum open while fitting same with an upstanding and free-standing post and a gated eye cooperating with one another to keep the unloaded end of the rope when slack from uncoiling off the open end. The open-ended drum permits the descent control device to be attached to the rope at any point between its ends without having to access either end. Moreover, even when loaded, turns can be added or removed from the drum using an accessible medial portion of the unloaded section hanging therebeneath without having to take ahold of the free end, unthreading and thereafter rethreading it.

It is, therefore, the principal object of the present invention to provide a novel and improved stationary drum friction device for use with a rope wrapped therearound to control the descent of a load suspended therefrom.

A second object is to provide a device of the type aforementioned wherein one end of the drum is left open so that turns can be added or subtracted under load using an unloaded portion of the slack end without having to unthread and rethread the latter.

Another object of the invention herein disclosed and claimed is to provide a load-lowering device which when used in association with a rope and body harness provides a means for escaping from multi-story buildings as well as more conventional uses yet comprises a total package weighing only a few pounds.

Still another objective is the provision of a friction-type escape device wherein an obstruction adjacent the open drum end cooperates with an open or openable eye therebeneath to keep the unloaded end of the rope hanging therebeneath from uncoiling off the drum when slack.

An additional object of the invention forming the subject matter hereof is to provide a friction-type escape device that can be attached to the rope at any point between its ends without accessing either end.

Further objects are to provide an escape system which is simple, easy to use, safe, reliable, lightweight, rugged, compact and even decorative.

Other objects will be in part apparent and in part pointed out specifically hereinafter in connection with the description of the drawings that follows, and in which.

Figure 1:
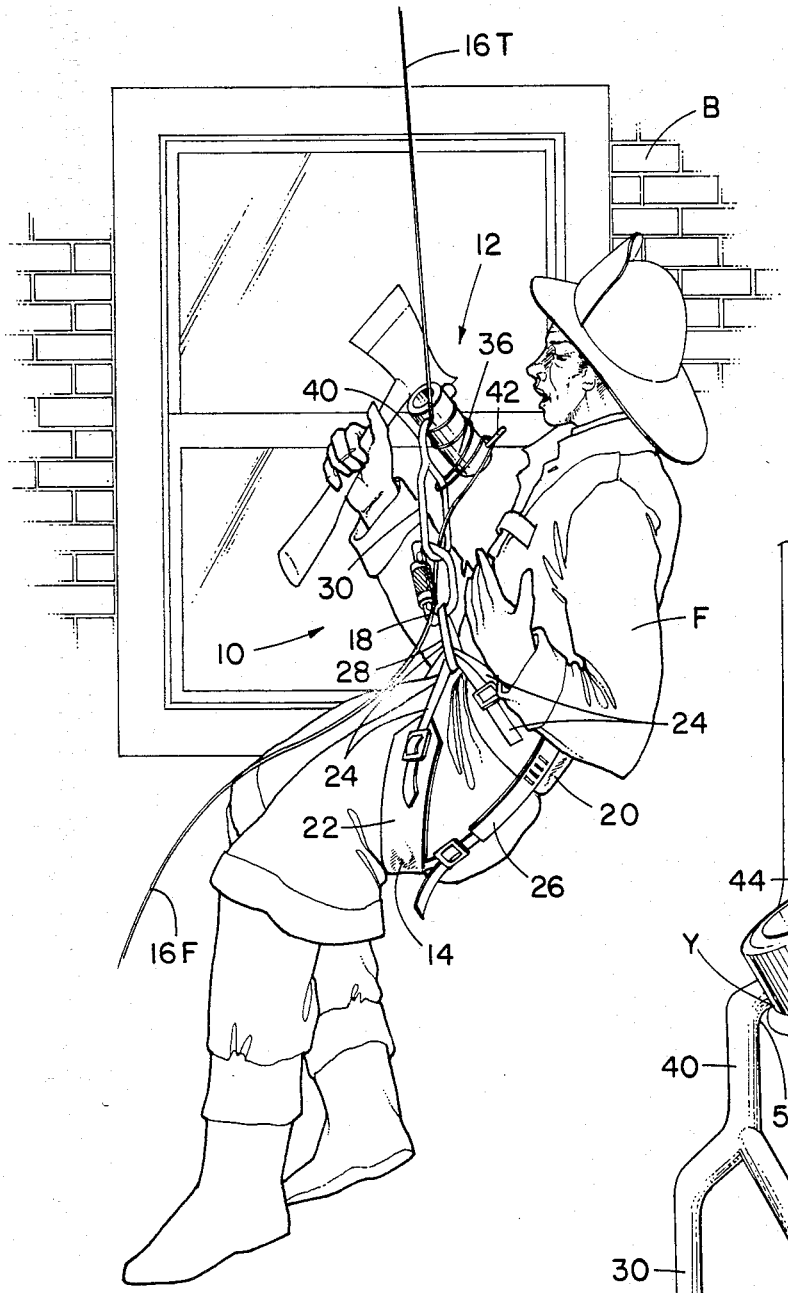
FIG. 1 is an elevational view showing the friction device of the present invention used in combination with a body harness and a rope tied-off to support a fireman with both hands free on the side of a building.
Figure 2:
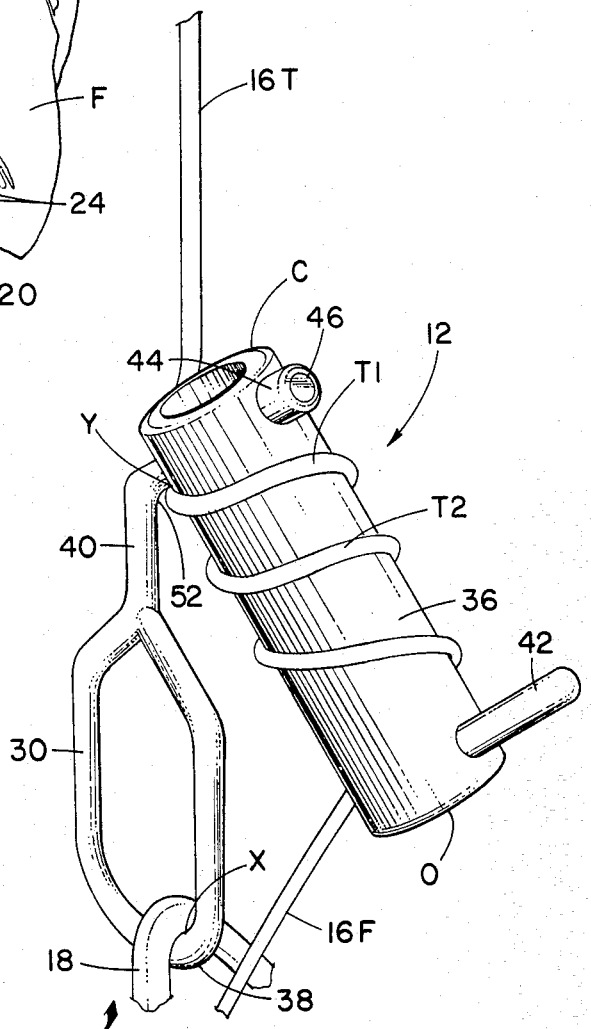
FIG. 2 is a fragmented perspective view to a greatly enlarged scale showing the friction device reaved with a rope and loaded, portions of the rope and carabiner hanging therefrom having been broken away to conserve space.

Referring next to the drawings for a detailed description of the present invention and, initially, to FIGS. 1 and 2 for this purpose, reference numeral 10 has been chosen to broadly identify the entire assembly by which a person may lower himself or herself from an elevated position while numeral 12 similarly denotes the novel element thereof, namely, the friction device by means of which the rate of descent is controlled, interrupted or stopped altogether. Other conventional, but nonetheless necessary, elements of the system are the body harness 14 and the rope 16. Also included in the particular form shown is a quick-disconnect coupling 18 in the form of a commercially-available carabiner.

Body harness 14, in the form shown in FIG. 1, comprises a waist-encircling belt member 20, an under-thigh belt member 22, adjustable straps 24 interconnecting these belt members across the front of the body, vertical straps 26 adjustably interconnecting these same belt members alongside the body, and a loop 28 joining together the straps 24 in front of the body. Harnesses of this type comprise one type of body support which can and does function quite satisfactorily with the other elements of the system. It has the advantage of being light yet strong, readily adjustable to users of different sizes and weights and, most important, totally reliable in the sense that the wearer cannot fall out of one even when unconscious. There are, of course, other types of body harnesses that will function quite satisfactorily, the one shown being intended as merely representative thereof.

Rope 16 can, obviously, be of the braided nylon sheath and core type used by mountain climbers which is very pliable, relatively lightweight and yet possesses high tensile strength. When properly used a rope sold commercially under the trademark "Kevlar" would seem to be ideal for use in escaping from burning buildings and the like since it is highly fire resistant, very strong in tensile strength for its size (diameter), nearly as pliable as other types of rope of comparable diameter while, at the same time, weighing a fraction of what other ropes weigh having equivalent carrying capacity. The limitation of this type of rope is that it loses tensile strength when knotted or otherwise bent around a small radius of less than approximately ten times its diameter. For present applications, however, this limitation can be disregarded as insignificant since a Kevlar rope only 5/32 inch in diameter has a tensile strength of around 2600 pounds thus exceeding by a factor of ten or more any human body it is likely to have to support. Enough Kevlar rope of this size to reach the ground from the roof of a thirty story building assuming an average of about twelve feet per floor would weigh about 3¾ pounds. It together with the friction device 12 which weighs less than a pound and the harness 14 total around six pounds in all. Moreover, the entire escape package can be carried in a satchel smaller than a briefcase. Professional users, like firemen, can carry a complete system in the "kangaroo-pouch" in their coats.

Quick-disconnect coupling 18, as previously noted, comprises a standard mountain climber's carabiner which is first to make the detachable connection between the eye 30 in the friction device 12 to be described in detail presently and the body harness 14, particularly the loop 28 carried by the latter in the form of harness shown in FIG. 1. Its other function is to releasably receive a medial portion of the unloaded end 16F of the rope hanging beneath the drum without having to access the free end of the rope. As will be explained presently, the carabiner is equipped with a latchable gate; however, this is not an essential feature since a permanently open gate can also be used where the rope enters by means of a circuitous path such that it is unlikely it will come out of its own accord.

Figures 5, 6:
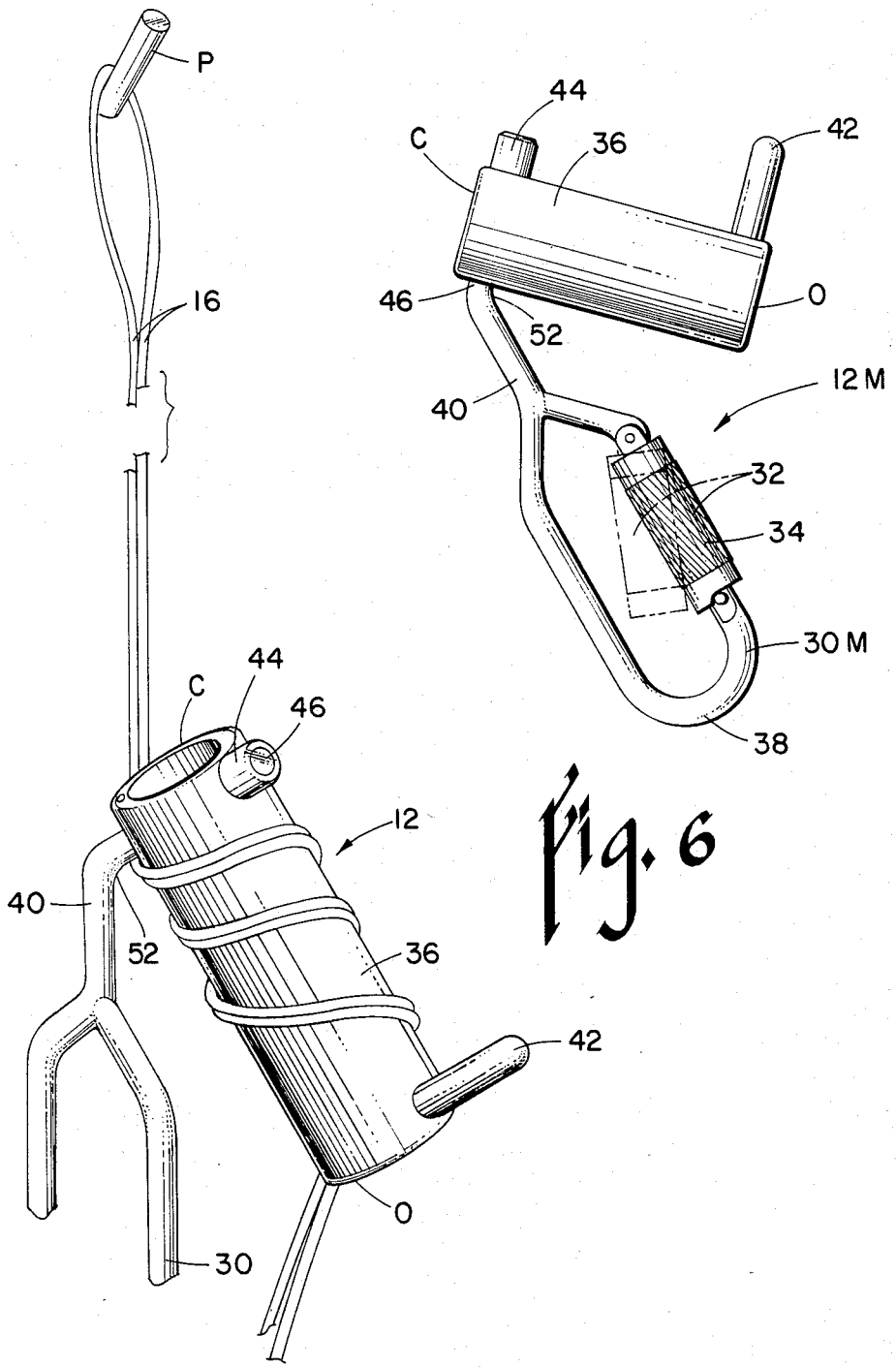
FIG. 5 is a perspective view much like FIGS. 2 and 3 and to the same scale showing the friction device reaved with a doubled-up retrievable rope; and, FIG. 6 is a perspective view much like the others but to a slightly reduced scale showing a modified form of the invention wherein the latchable gate is incorporated as an integral part of the eye in the dogleg arm.

Referring briefly to FIG. 6 where a modified form 12M of the friction device has been shown, it can be seen that the eye 30M of this version has been combined with the carabiner 18 to incorporate the latchable gate 32 of the latter. This latch which is commercially available includes a rotatable sleeve 34 which is spring-biased by a spring (not shown) into a closed normally-latched position shown in full lines in FIGS. 1, 3, 4 and 6. By rotating it a fraction of a turn, it unlatches and can then be moved to the open phantom line position of FIG. 6 to receive the rope 16.

By incorporating this or some type of rope-receiving gate in the eye of the friction device, carabiner 18 can be eliminated and the friction device attached directly to the body harness 14 as well as the unloaded rope section 16F. The tooling and production costs associated with incorporating the carabiner latch into the eye when carabiners of the type shown are readily available at a moderate cost, at least at the present time, mitigate against combining the two even though doing so results in a simpler assembly.

Referring next to FIG. 2 of the drawings for a detailed description of the friction device 12, it will be seen to include, in the particular form shown, a tubular drum 36 around which several turns of the rope 12 are wound or wrapped in accordance with conventional practice. Applicant has found that three turns appear to be optimum for the average adult in terms of speed of descent and control over the latter. A heavy person weighing in excess of 200 pounds might feel more comfortable with an extra turn while children would use only two. More significant than the number of turns is the fact that due to the open-ended construction of applicant's friction drum which is its most important feature, a user can attach it at any point between the ends of the rope and, in addition, can add or subtract turns using an accessible medial portion thereof that is not under load while the assembly is fully loaded without having to unthread, rethread or even access the free end hanging therebeneath. Specifically, to add or take off turns, the user need only grasp the turns T1 and T2 (FIG. 2) at the upper or closed end C of the drum 36 and squeeze them against the surface of the latter while at the same time taking ahold of an accessible medial section of the unloaded portion 16F of the rope and either adding a turn or unwrapping same to take off one. It should be noted that while the free end of the rope is retained in the carabiner 18 (full lines in FIG. 3) it does not have to be, and for safety reasons should not be, unthreaded or taken out through latch 32 to accomplish the latter. The free end can even be held so long as there is enough slack to add or take off turns or tie it off in the manner of FIGS. 3 and 4. No other stationary drum friction device so far as applicant is aware permits the user to add or subtract turns while the system is loaded without having to first unthread the free end of the rope and subsequently rethread it, the latter being possible due to the open-ended drum construction wherein no obstruction exists between open end O and the free end 38 of dogleg arm 40 where eye 30 is located. No gate or a latch of the type shown in Wood's U.S. Pat. No. 4,311,217 which is the closest prior art known to applicant, is needed or even desired since its effect is to produce a close-ended drum of the type used by Barrington (U.S. Pat. No. 1,351,734).

The rope 16 in FIGS. 1–4 has its upper portion tied off or otherwise secured at some point (not shown) in or on the building B (FIG. 1). When loaded as shown in FIG. 1 with a fireman F sitting in the harness 14, the section of the rope 16T above the friction device 12 is under tension while the section 16F hanging free therebeneath is not. The rope is reaved as shown most clearly in FIG. 2 to pass underneath the dogleg arm 40 at the point where it attaches to drum 36, then several turns around the latter and finally down through the gated eye in either the carabiner or dogleg arm (FIG. 6).

Now, with the rope leaving the drum at an angle to its axis of not much over 90° as it makes its way through the gated eye therebeneath and offset toward the closed end carrying the dogleg arm, if the drum is long enough and the unloaded rope end 16F kept under tension, it will not uncoil off the open end O of the drum. On the other hand, if this unloaded rope section 16F is allowed to go slack, the tilt of the drum axis such that the open end O is lower than the closed end C, obviously, creates a condition in which the rope can unwind off the drum thus losing the frictional contact vital to controlling the descent of the load. While, conceivably, the drum could be made so long that even with the unloaded end of the rope slack it could not escape off the open end, to do so would be counterproductive since it would mean adding more weight and bulk to the drum. For this reason, the preferred construction is to keep the drum short while equipping it with an abutment of some sort adjacent its free end effective to keep the rope from unwinding. Such an abutment can take many forms, however, the one shown, namely upstanding post 42 which, in addition to keeping the rope from coming off the open drum end, provides a means for tying off the rope in the manner shown in FIGS. 1 and 4. Thus, while one could lower himself or herself by merely wrapping the rope several turns around the drum and holding it in place thereon while it is permitted to slip, such a condition is extremely dangerous and eliminates a most important feature of applicant's apparatus, namely, that of being able to control the descent from the ground. Accordingly, the dual purpose upstanding post 42 and gated eye cooperate to give the user control at all times even with a slack rope. More important, it provides a load-lowering device which can be controlled on the ground to safely lower an unconscious or panic-striken victim.

It is well known in connection with stationary friction drum devices of this type that grasping free end 16F of the rope lightly between the thumb and forefinger of one hand is enough to stop the descent in midair. The same is true when grasping turns T1 and T2 to add or subtract turns. Thus, the user can control his or her descent at any speed he or she wishes. Also, when using the rope as shown in FIGS. 1–4 with one end fixed and the other reaching to the ground or other suitable place of safety, a person at such location can control the descent of an unconscious victim with no difficulty.

Turning briefly to FIG. 5, it will be seen that the rope 16 has been doubled-up and looped around a suitable support represented somewhat schematically by peg P. In instances where the length of rope is not long enough to reach a point of safety in a single rappel but must be made in stages, then, obviously, the rope must be retrieved. This is simply done, of course, by using the climbing technique of doubling up on the rope as shown. Once a ledge or other intermediate support is reached, the user pulls one leg of the rope to free same from the support P and reattaches it to another similar point of attachment accessible from his or her present location. This step-wise process is repeated as often as necessary to reach the ground or other objective.

Figure 3:
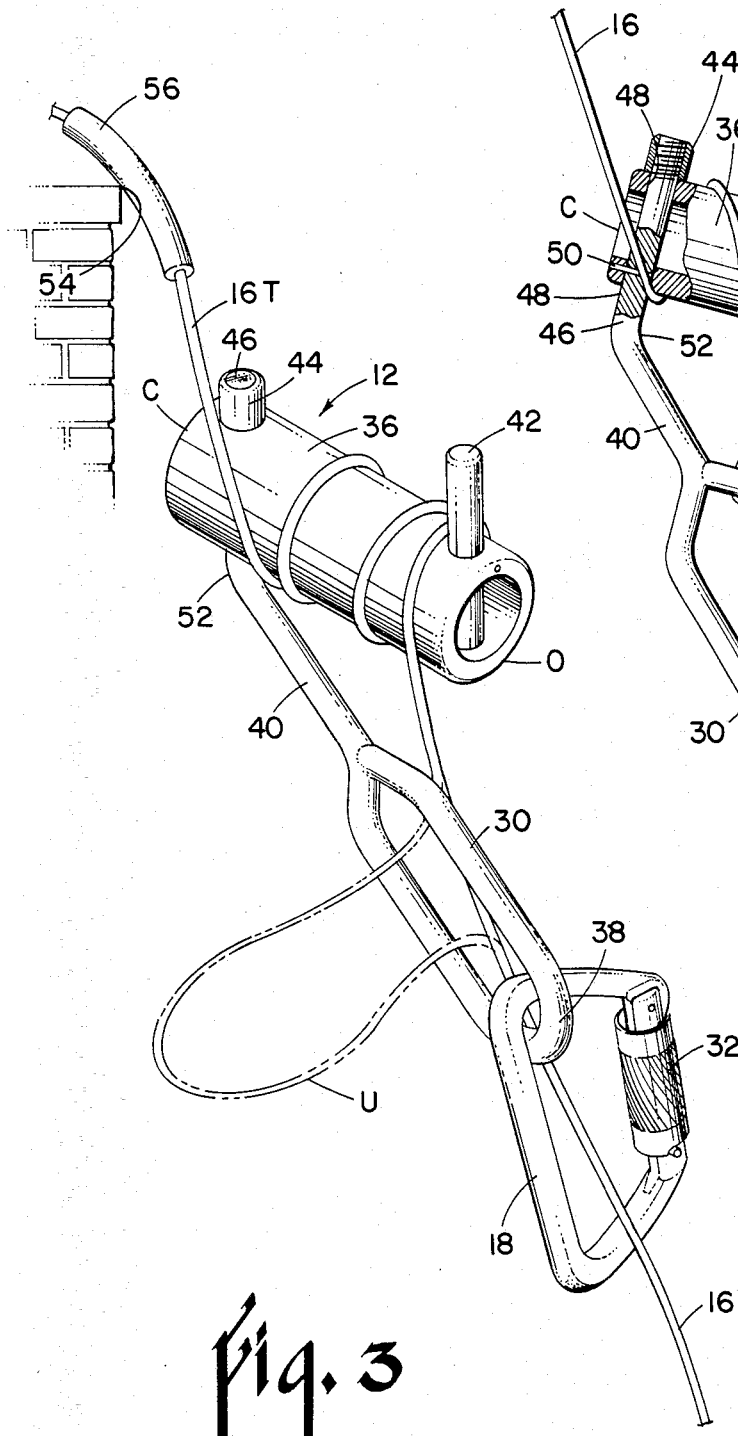
FIG. 3 is a perspective view much like FIG. 2 and to approximately the same scale showing the first step in tying off the system so as to suspend the load in midair without having to hold onto the unloaded end of the rope, the rope having been shown reaved in the opposite direction around the drum.
Figure 4:
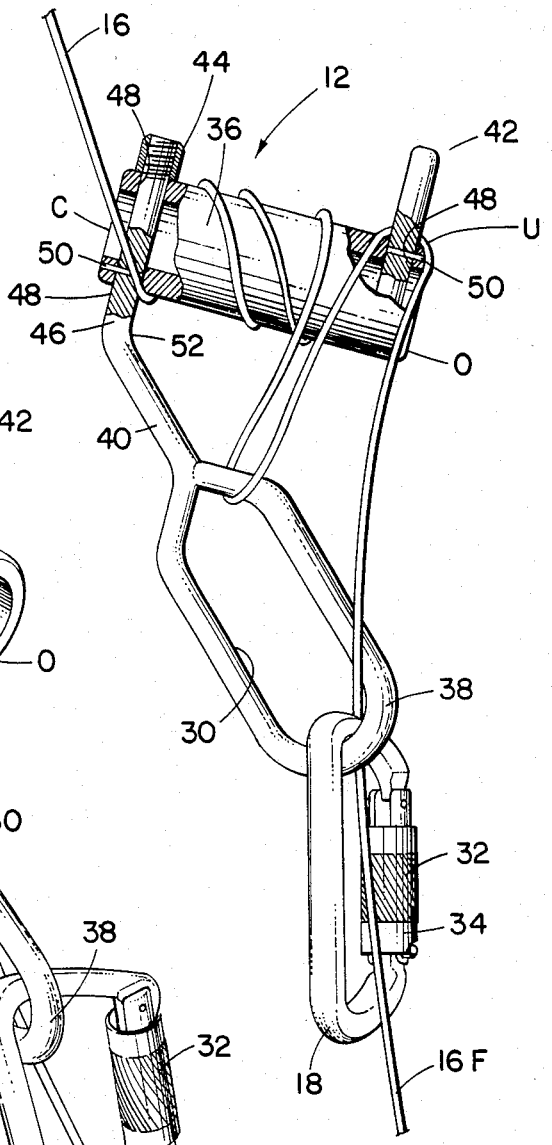
FIG. 4 is a side elevation, again to approximately the same scale, showing the final step in the tied-off mode wherein the bight drawn through the ungated eye in the dogleg arm is looped around the free-standing drum post, portions of the drum and associated parts having been broken away and shown in section to more clearly reveal the interior construction.

In FIGS. 1, 3 and 4, applicant has shown the mechanism used to temporarily "tie-off" the system so as to stop the descent while at the same time, freeing both hands as in the case of the fireman shown in FIG. 1 using his axe. To tie-off the system under load, the user first grasps the turns of rope with one hand and lightly squeezes them against the surface of drum 36 in the same way he or she would do in order to add or subtract turns. Doing so, of course, stops the descent. Then, using the other hand, a section of the unloaded or slack section 16F or rope 16 is pulled through eye 30 as shown in phantom lines in FIG. 3 to form a U-shaped bight U. While still holding the turns tightly against the drum, bight U is looped over post 42 as shown in FIG. 4 to complete the tie-off. When the hand holding the turns against the drum is released, the additional bends and friction developed by bight U as it loops over post 42 will stop the rope from slipping on the drum and leave both hands free for other tasks. Reversing the above procedure will, of course, free the system to continue the descent.

In the doubled-up system of FIG. 5 the same objective can be accomplished in the same way using either a single or double strand of the unloaded section 16F. Another way of temporarily tying-off the system is to take the portion of the unloaded section 16F of the rope after it has passed through the carabiner 18 and loop it over post 42. In the modification of FIG. 6 where the line goes through eye 30M instead of alongside thereof, this would probably be the method used to tie-off the system.

Returning again to FIG. 4 to continue the detailed description of the friction device 12, it can be seen that the drum as shown includes a second post 44 at its upper end. This post has no function other than simplifying the assembly and can be eliminated. In the form shown, the section 46 of the dogleg arm passes through aligned apertures 48 in the upper or closed end of the drum and out the top. The tip is threaded as shown and post 44 comprises a nut screwed onto this threaded tip.

On the bottom of the drum where section 46 of the dogleg arm enters the latter, the wall of the drum is drilled and pinned as shown at 50 to fasten these elements together. The same arrangement is used on the open end O of the drum to fasten post 42 in place.

FIG. 2 most clearly reveals the relationship of the parts which, in certain respects, is most significant. When under load as shown, the point X from which the load is suspended and the point Y where the tensioned end 16T of the rope leaves the drum define a line essentially paralleling the latter and lying well to one side of the point where the final turn of the rope leaves the drum. In the particular arrangement shown, the final turn of the rope adjacent the open end O will lie snug up against abutment-forming post 42. Drum 36 has its axis inclined at an acute angular relation to line X—Y of about 45°. To prevent the overlapping of turns on the drum which results in knotting that cannot be undone under load, the axis of the drum must be such that the closed end C is higher than the open end O, i.e. inclined downwardly relative to the horizontal. Preferably, the inclination is steep enough and the length of the drum long enough measured axially that it will accommodate a minimum of four single turns or two double turns with the rope doubled-up in the manner shown in FIG. 5. In a tied-off situation such as that shown in FIGS. 1 and 4, the bight U could overlie a turn of the rope on the drum and cause no problem; however, even here, enough space on the drum should be provided to accommodate all the loose-wound turns that will ever be needed along with a tie-off loop since the increase in bulk and weight to do so is inconsequential. Also, by providing somewhat of an excess of drum length, one is not restricted to any particular size of rope. The bend 52 in the dogleg must, therefore, be such that when the load-suspension point X in the eye and point Y at the juncture between the arm and drum define a line paralleling the tensioned part of the rope 16T, the axis of the drum must be inclined downwardly from its closed to its open end or, otherwise, the rope reaved around the latter will build up turn-atop-turn, knot and cause the system to jam. It should be noted in this connection that the tensioned part 16T of the rope will seldom be vertical (see FIG. 4) but more often inclined so as to elevate the open end of the drum and this fact needs to be considered when deciding upon the angle 52 in the dogleg, one of 45° or so having proven quite satisfactory.

Briefly with reference to FIG. 3, the rope 16 which is shown untensioned, may have to be draped across a sharp corner such as a window ledge at which point the bend in a rope made of Kevlar could, conceivably, damage same. A sleeve 56 or other protective device of a type well known in the art should preferably be employed as shown.

What is claimed is:

1. A descent control device for use with a load-carrying harness suspended therefrom to lower a load on a rope from an elevated position where one end is anchored down to a relatively lower position reached by its free end which comprises: a friction drum of a length adapted to receive a plurality of turns of rope wrapped therearound, said drum having two ends, an arm attached adjacent one of said two ends hanging down beneath the drum and cooperating therewith to define a first rope retaining means effective to prevent the anchored end of the rope from unwinding off said one end when tensioned from above, gated means carried by said arm for connecting same to the load-carrying harness and for receiving and releasably retaining a medial section of the rope without accessing the end thereof; and abutment-forming means positioned adjacent the other of the two drum ends spaced from the arm so as to leave a medial section therebetween to receive the plurality of turns, said abutment-forming means defining a second rope retaining means effective to prevent the free end of the rope hanging therebeneath from unwinding off said other end, and said drum and arm and abutment-forming means all cooperating when supporting a load to leave said other drum end open and permit a slack portion of the rope intermediate its ends to be used to add or subtract turns from said drum while one or more of the turns to remain are squeezed thereagainst tightly enough to prevent slippage.

2. The descent control device as set forth in claim 1 wherein the abutment-forming means comprises an upstanding post.

3. The descent control device as set forth in claim 1 wherein the gated means carried by the arm for connecting same to the load-carrying harness comprises an integrally-formed eye.

4. The descent control device as set forth in claim 1 wherein the gated means carried by the arm for connecting same to the load-carrying harness comprises coupling having a latchable gate therein.

5. The descent control device as set forth in claim 1 wherein the medial section of the drum is of a length to accept a minimum of four turns of rope wrapped therearound in side-by-side relation to one another.

6. The descent control device as set forth in claim 1 wherein said first and second rope retaining means each comprise corners defined by the intersections of said post and said abutment-forming means with said drum.

7. The descent control device as set forth in claim 1 in which: the arm includes an integrally-formed eye, the second rope retaining means comprises an upstanding post mounted on the drum adjacent the open end thereof, said post and eye cooperating with one another when a U-shaped bight in a slack portion of the rope is drawn through said eye and placed over said post to releasably fasten the drum in fixed position.

8. The descent control device as set forth in claim 2 wherein the height of the post is at least twice the diameter of the rope.

9. The descent control device as set forth in claim 3 wherein the eye includes a normally-closed gate forming means openable to receive a slack portion of the rope intermediate its ends.

10. The descent control device as set forth in claim 7 in which: the first rope retaining means and post cooperate to confine the turns of rope wrapped around the drum to the medial section thereof while said post at the same time allows turns to be added or subtracted therefrom without having to unthread or remove the slack section of the rope from the second rope retaining means.

* * * * *